United States Patent [19]

Castanoli, deceased et al.

[11] 4,159,149

[45] Jun. 26, 1979

[54] COAL MINING AUGER

[76] Inventors: Alder F. Castanoli, deceased, late of Huntington, W. Va. by Eleanor J. Castanoli Henkle, executrix, c/o Stoll & Stoll, Empire State Bldg., New York, N.Y. 10001

[21] Appl. No.: 779,028

[22] Filed: Mar. 18, 1977

[51] Int. Cl.[2] ..... E21C 25/06

[52] U.S. Cl. ..... 299/80; 299/86; 175/106; 175/272; 175/319; 299/87

[58] Field of Search ..... 299/80, 86, 87; 175/272, 268, 292, 106, 319

[56] References Cited

U.S. PATENT DOCUMENTS

| | | | |
|---|---|---|---|
| Re. 27,470 | 11/1963 | Alliman | 299/86 |
| 514,111 | 2/1894 | Abraham | 175/272 |
| 1,532,243 | 4/1925 | Hebsacker | 299/87 |
| 2,797,065 | 6/1957 | Houston | 175/106 |
| 2,919,121 | 12/1959 | Ruth | 299/86 |
| 3,032,128 | 5/1962 | Walton | 175/292 |
| 3,322,466 | 5/1967 | Mennekes | 175/10 C X |
| 3,642,325 | 2/1972 | Mulvaney | 299/80 |
| 3,856,357 | 12/1974 | Wharton | 299/87 |

*Primary Examiner*—Ernest R. Purser
*Assistant Examiner*—William F. Pate, III
*Attorney, Agent, or Firm*—Stoll and Stoll

[57] ABSTRACT

A coal-mining auger having (a) a hollow, tubular auger head with a spiral or helical coal conveyor mounted therein in concentric relation to the axis of rotation of said auger head, (b) a plurality of coal-cutting bits mounted on said auger head, said bits being orbitally movable with the auger head in circular paths concentric with said axis of rotation, said bits being also concurrently rotatable about their individual axes, and (c) coal-cutting bits which are radially adjustable relative to said axes of rotation. The individually rotatable bits are driven by planetary gear trains which are driven by the main auger shaft.

9 Claims, 10 Drawing Figures

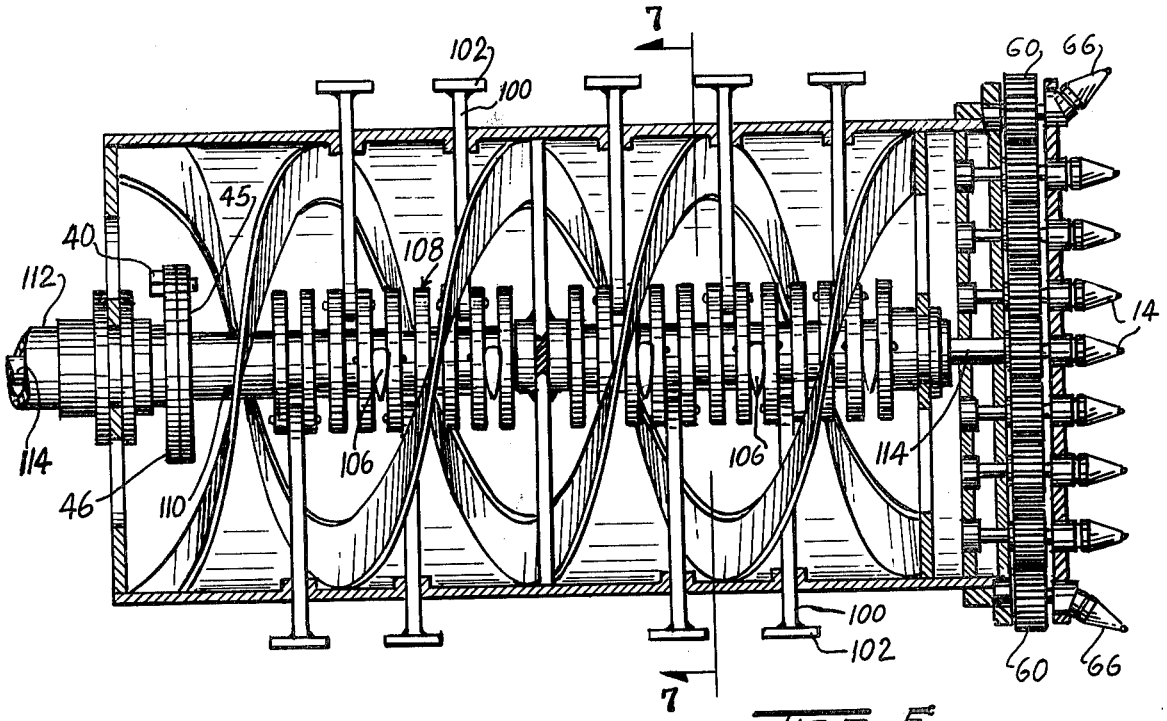
Fig. 5
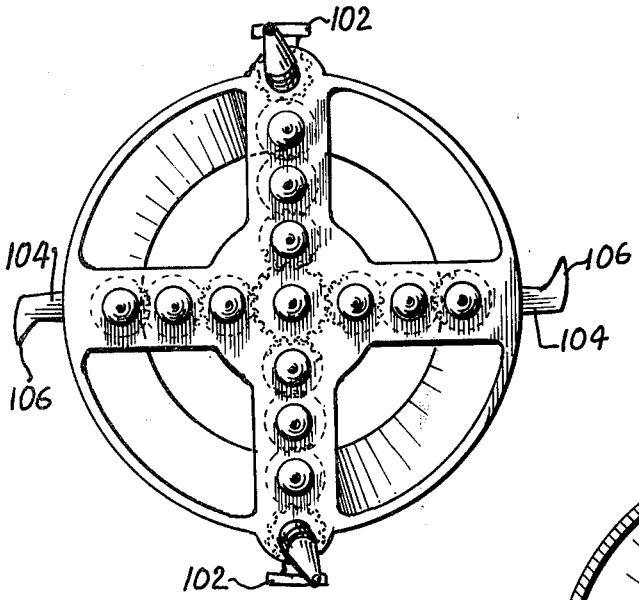
Fig. 6
Fig. 7
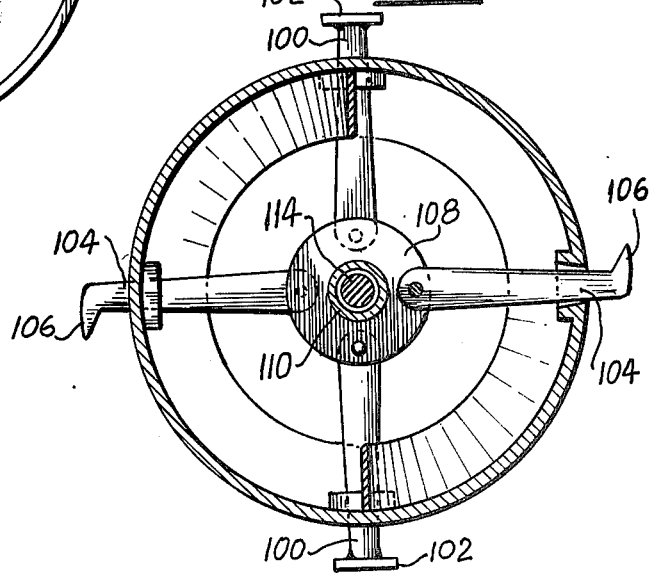

COAL MINING AUGER

BACKGROUND OF THE INVENTION

1. Field of Invention

This invention relates to auger mining of coal, especially, but not limited to, bituminous coal.

2. Prior Art

The closest prior patent art known to applicant consists of the following U.S. Pat. Nos.: 864,704, 2,976,027, 1,420,918, 3,064,958 2,734,733 3,215,214 2,766,028, 3,342,276 2,772,870 3,412,816 2,797,065.

U.S. Pat. No. 3,215,214 shows cutting elements which are individually rotatable about their own individual axes but this patent does not show the combination of rotary and orbital drives which are disclosed in the present application.

U.S. Pat. No. 2,766,028 shows an expansible auger head, but it does not show applicant's expansion method nor the combination of applicant's expansion method and his rotary and orbital bit drives.

Nor do these prior patents show applicant's hollow auger head with its internal spiral or helical coal conveyor.

SUMMARY OF THE INVENTION

Despite the patents of the prior art, as heretofore set forth, conventional auger mining is conducted by means of augers having fixed diameters and fixed cutting bits. To avoid cutting into the overburden, augers of smaller diameter than the height of the coal seam are frequently used. For example, 30 inch augers are sometimes used in 40 inch coal. Sometimes 30 inch augers are applied to coal of inconsistent height, e.g., coal whose height varies from 32 to 38 inches. A cut of fixed diameter, in such cases, is highly wasteful of coal.

The present invention makes it possible to adjust the effective diameter of the auger to the height of the coal and to readjust the diameter as required by the conditions encountered in the course of the augering operation.

Applicant provides two methods of adjusting the effective diameter of the auger head, both methods extending or retracting the cutters radially of the axis of rotation of the auger head. In one case the cutters are pivotally mounted on the auger head; in the other case they are slidably mounted thereon.

In conventional augers the cuttings bits are fixed relative to the auger head and they wear unevenly as a consequence, that is, wear occurs primarily on the side or edge of the cutting bits which cuts into the coal. This is a wasteful and inefficient practice.

In applicant's machine the cutting bits on the forward face of the auger head rotate about their individual axes. Consequently, they wear evenly around their entire circumference and remain sharper for longer periods of time. The result is not only a prolongation of the effective life of the bits, but also a more efficient augering operation.

Another feature of applicant's invention resides in the use of an internal coal conveyor. The auger head of applicant's machine is hollow and a spiral or helical conveyor is mounted therein. This facilitates the rearward flow of coal which otherwise would have to pass through the narrow space between the auger head and the wall of the borehole.

BRIEF DESCRIPTION OF THE DRAWING

FIG. 5 is a longitudinal section, similar to that of FIG. 2, but showing a modified form of the invention.

FIG. 6 is a face view in the direction of arrows 6,6 of FIG. 5.

FIG. 7 is a transverse section on the line 7—7 of FIG. 5.

DESCRIPTION OF PREFERRED EMBODIMENTS OF THE INVENTION

Figure 1:
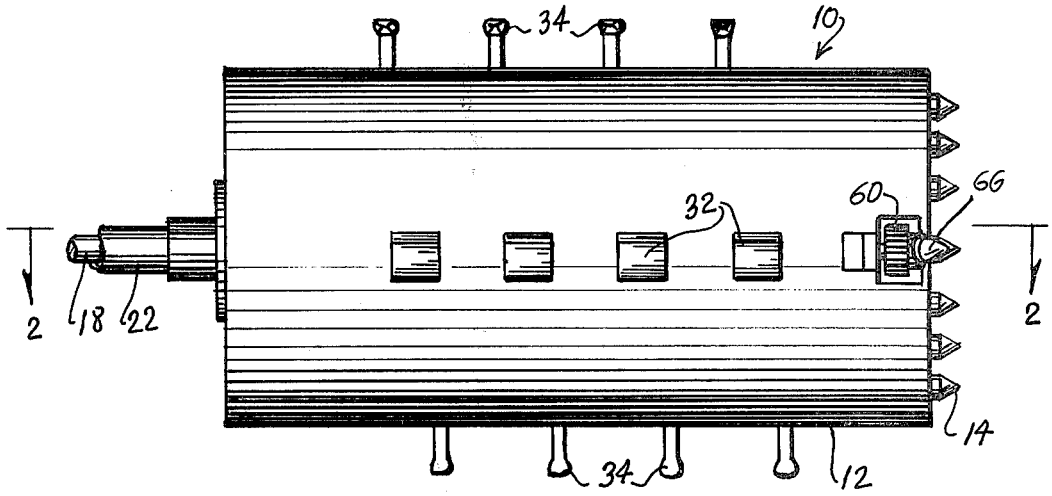
FIG. 1 is a side view of an auger made in accordance with one embodiment of the invention.

Referring to the first form of the invention as illustrated in FIGS. 1-4 of the drawing, it will be seen that auger 10 has a hollow, drum-shaped auger head 12, a plurality of cutting bits 14, a planetary gear train 16 driving said cutting bits, a relatively fast inner shaft 18 driving the sun gear 20, an outer tubular shaft 22 comprising the main drive shaft which drives the auger head, an intermediate tubular shaft 24, a plurality of eccentrics 26 on said intermediate shaft, and a plurality of arms 28 and 30 mounted on said eccentrics arms 28 are provided with bearing pads 32 at their outer ends to serve as auger head guides with respect to the walls of the boreholes formed by the auger. Arms 30 are provided at their outer ends with coal-cutting elements 34.

It will be understood that tubular drive shaft 22 is connected to the main power drive of the auger by conventional means. The main power drive is also conventional. Neither the latter nor the former is shown in the drawing and neither is herein claimed. The hollow auger head 12 is secured to and supported by tubular drive shaft 22 and mounting 36 illustrates conventional means for securing said auger head to said tubular drive shaft.

Tubular shafts 22 and 24 rotate together, but shaft 24 is angularly adjustable relative to shaft 22. Conventional means are provided for rotating shaft 24 in small increments, say 15 degrees increments, relative to shaft 22 to a total of 180 degrees. Conventional means are provided to fix shaft 24 in its adjusted position relative to shaft 22 so that they may rotate as one shaft. Purely by way of illustration, bolts 40, operating through registering holes 42 and 44 in mounting 36 and annular flange 46, may be used to secure the two shafts together in selected relative angular positions. A suitable calibrated dial may be provided for visual determination of the angular position of flange 46, and hence tubular shaft 24, relative to mounting 36 and tubular shaft 22.

The purpose of the angular adjustment between shafts 22 and 24 will now be described. Arms 28 and 30 extend radially outwardly from the eccentrics 26 on which they are mounted, and these arms project outwardly from the auger head 12 through suitable bearing supports 48 which are secured to said auger head. Eccentrics 26 are secured to tubular shaft 24 so that they turn relative to tubular shaft 22 when shaft 24 is rotated relative to shaft 22. The adjusted angular position of eccentrics 26 determines the radial position of said arms 28 and 30, that is, the extent to which they are caused to project outwardly from the auger head. This, in turn, will determine the cutting radius of cutters 34 and the bearing radius of bearing pads 32.

To illustrate this feature of the invention, a 6 inch range of radial movement of arms 28 and 30 will convert a 30 inch diameter auger to a 42 inch diameter auger or to incremental diameters between these extremes, these adjusted diameter determined by the holes 44 which bolt 40 engages.

Figure 2:
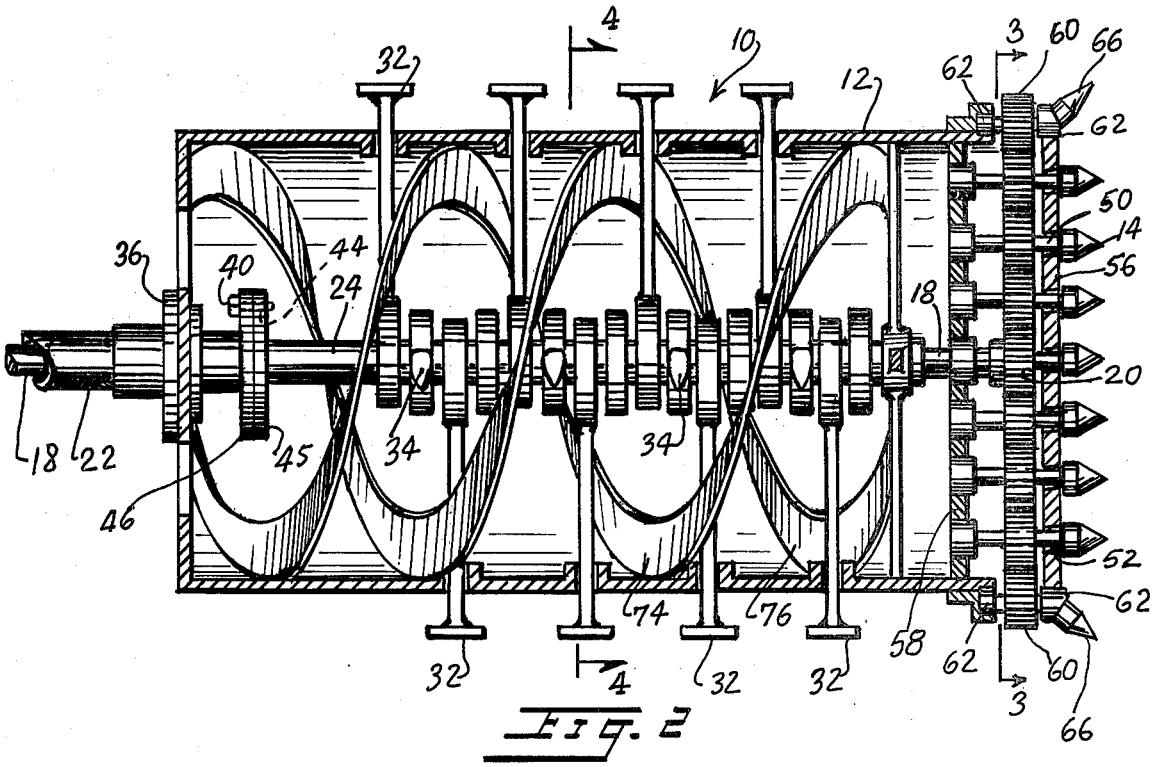
FIG. 2 is a longitudinal section on the line 2—2 of FIG. 1.
Figure 3:
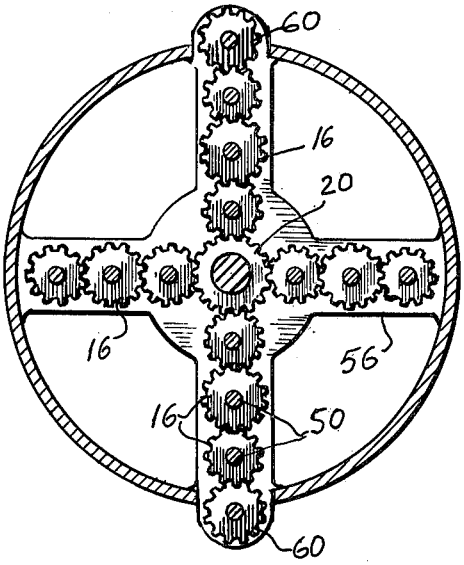
FIG. 3 is a transverse section on the line 3—3 of FIG. 2.
Figure 4:
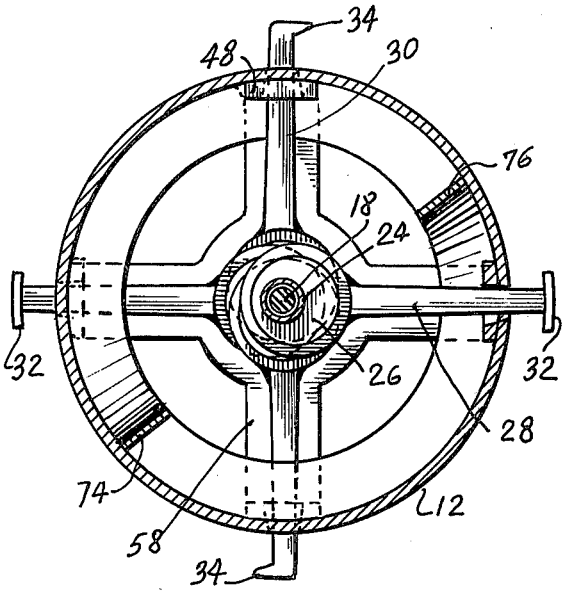
FIG. 4 is a transverse section on the line 4—4 of FIG. 2.

Referring now to FIGS. 2 and 3, it will be seen that cutting bits 14 are secured to shafts 50 which are supported by bearings 52, 54 on open frames 56, 58 of auger head 12. Planetary gears 16 are secured to said shafts 50 and sun gear 20 is secured to inner drive shaft 18. The center shaft 50 is secured to paid drive shaft 18.

It is evident from the foregoing that when auger head 12 is caused to rotate at a given velocity (by means of tubular drive shaft 22), and said inner drive shaft 18 is caused to rotate at a different-usually higher-velocity, the planetary gear trains shown in FIGS. 2 and 3 will cause the drill bits to rotate about their individual axes, in addition to revolving about the axis of drive shaft 18.

It may be desired to further increase the effective cutting diameter of the auger head by mounting additional planetary gears 60 thereon. This may be done by providing suitable bearings 62 on the auger head, journaling suitable shafts 64 therein, and mounting slidable cutting bits 66 on said shafts. Preferably outer bits 66 are set at an angle to extend the diameter of the borehole sufficiently to clear all protuberances on the auger head, including outer gears 60.

In addition to outer bits 66 (or as alternatives to them) fixed bits 70 may be provided on the auger head. These bits may be attached by means of brackets or holders 72 which are secured to the auger head.

Another feature of the above-described embodiment of the invention resides in the internal spiral or helical conveyors 74, 76. These conveyors are welded or otherwise secured to the inner wall of the auger head for integral rotation therewith. A single conveyor may also be used. As the auger advances into the coal seam, coal cut by bits 14, 66 and 70 tends to drop down to the bottom of the cut and also to enter the auger head through open frames 56 and 58. The coal that enters the auger head is conveyed therethrough by conveyors 74, 76 and out through open frame 78 in the back of the auger head. The coal that drops to the bottom of the cut, as well as the coal which is cut by radial cutters 34, passes out of the borehole through the clearance space between the borehole wall and the auger head.

The modification of FIGS. 5, 6 and 7 differs from the embodiment shown in FIG. 2 in the mounting for arms 100 which support bearing pads 102 and arms 104 which support coal-cutting bits 106. It will be observed that these arms are connected to crank elements 108 mounted on intermediate tubular shaft 110 which extends through tubular main drive shaft 112. Shafts 110 and 112 rotate integrally with each other. However, shaft 110 is adjustable relative to shaft 112 to the extent permitted by the crank elements and arms supported thereby. The range of angular adjustment extends to approximately 170 degrees, but the linear adjustment of arms 100 and 104 exceeds that of arms 28 and 30 above described.

In this form of the invention, as in the first form above described, there is an inner shaft which drives the planetary gear trains. Shaft 114 in FIG. 5 corresponds to shaft 18 in FIG. 2. Other corresponding parts bear like reference numerals.

Figure 8:
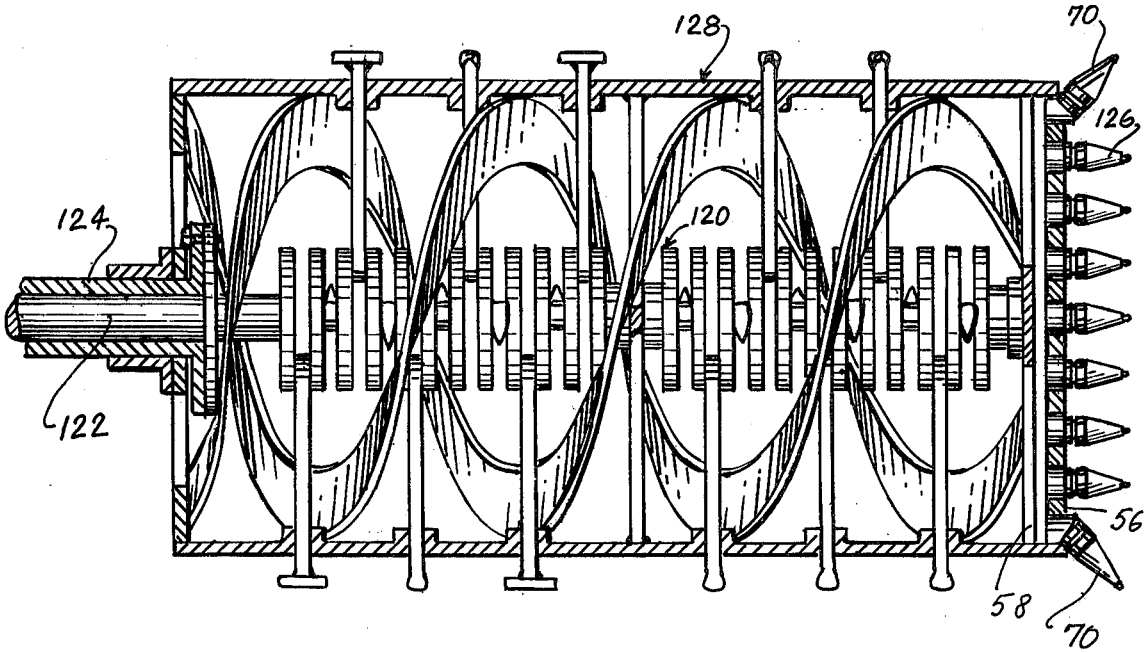
FIG. 8 is a view similar to that of FIG. 5, but showing a further modification of the invention.

It will be understood that a variation of the second form of the invention may be provided without the planetary gears and inner drive shaft 114. In such case arms 100 and 104 will be mounted on a more conventional crankshaft 120 connected to shaft 122 within maindrive shaft 124 as shown in FIG. 8. Since there are no planetary gears in this embodiment, there is no need of an inner shaft corresponding to shaft 114 of FIG. 5. Moreover, the cutting bits 126 are fixed to the auger head 128. Of course, the embodiment of FIG. 8 does not have the feature and advantages of cutting bits which rotate about their individual axes.

Figure 9:
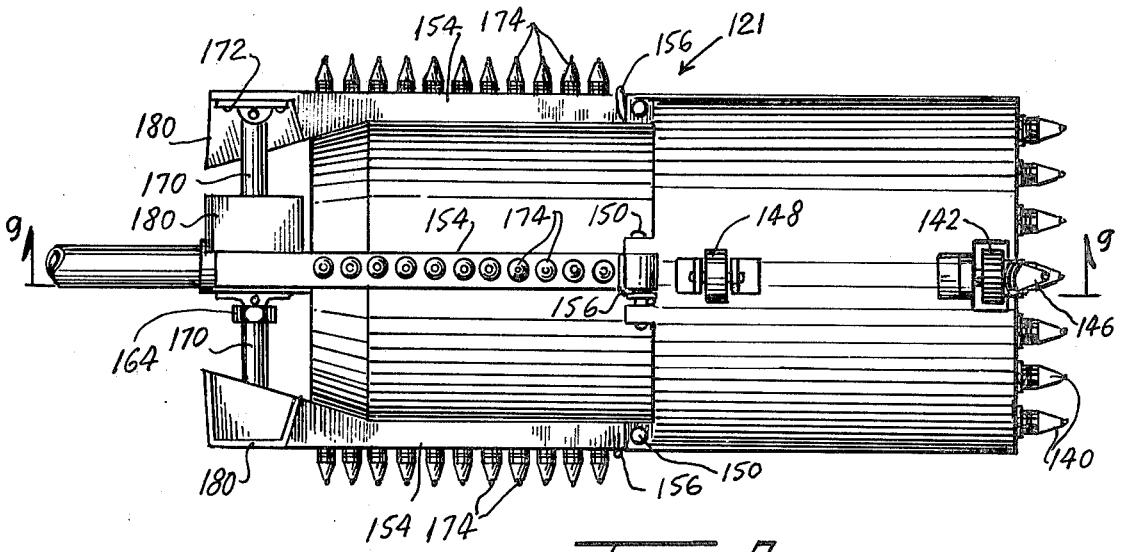
FIG. 9 is a side view of an auger made in accordance with a third form of this invention.
Figure 10:
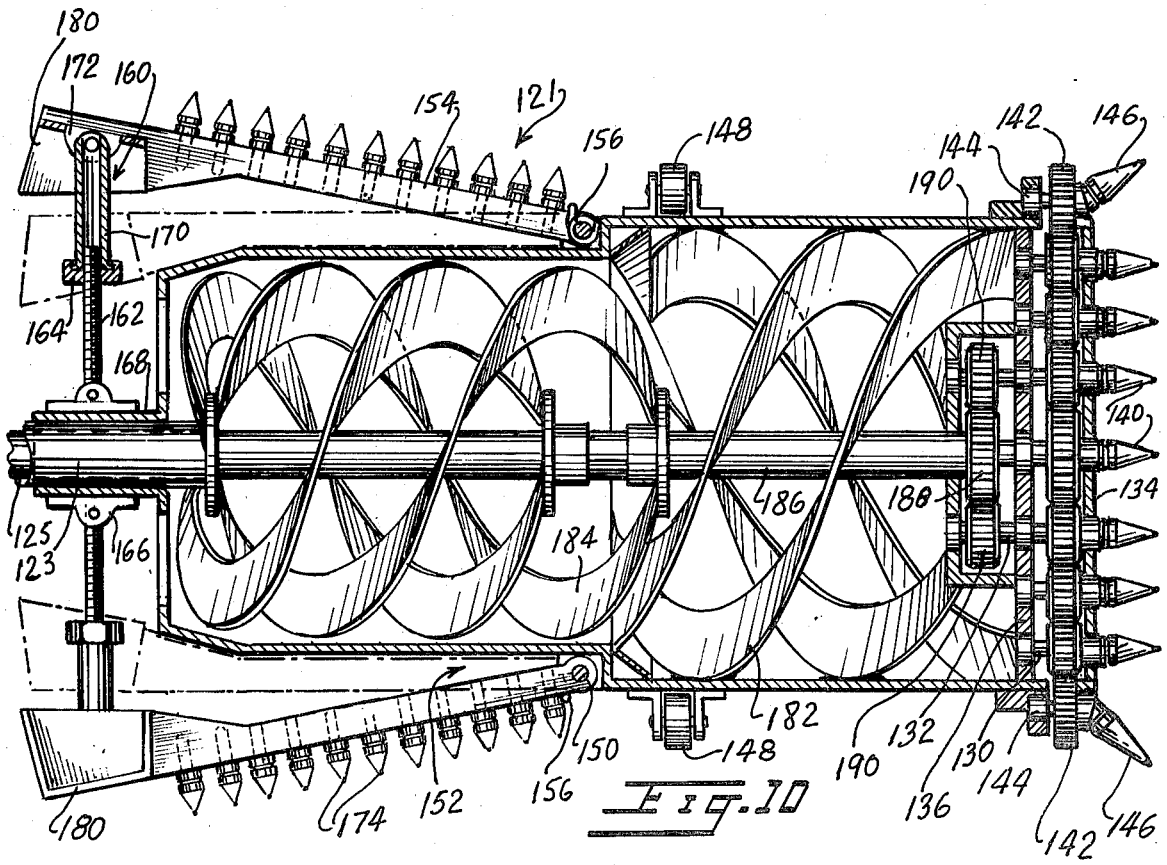
FIG. 10 is a longitudinal section on the line 10—10 of FIG. 9, showing the adjustable cutters in outwardly extended positions.

The fourth form of the invention is illustrated in FIGS. 9 and 10 of the drawing. Specifically, auger head 121 is mounted on and driven by tubular drive shaft 123. Extending through said tubular drive shaft 121 is a drive shaft 125 which drives planetary gears 127 through a sun gear 129. Most of the planetary gears are mounted on shafts 130; at least two are mounted on longer shafts 132. As will be seen, shafts 130 are supported on open frames 134, 136; longer shafts 132 are supported on open frames 134, 138, the latter being itself supported on frame 136.

Secured to the forward ends of the shafts 130 and 132 are coal-cutting bits 140. As will be understood, when drive shaft 125 operates (at a faster velocity than drive shaft 123) the sun and planetary gears will cause the cutter bits to rotate about their respective axes, while concurrently orbiting around the axis of said drive shaft 125. Preferably, outer planetary gears 142 are also provided on the auger head, being supported by shafts on suitable bearings 144, and angled bits 146 are mounted on said shafts, thereby increasing the cutting radius of the auger to encompass all projections thereon, such as support rollers 148.

Pivotally mounted on the auger head 121 by means of pins 150, within recesses 152, is a plurality of cantilever arms 154. Torsion springs 156 may be provided on pins 150 to urge the cantlever arms into, and to confine them in, said recesses 152. It will be observed that it is at their forward ends that the cantilever arms are pivotally supported by the auger head. At their rear ends, the cantilever arms are supported by suitable jack mechanisms, such as jack 160. Each jack 160 comprises a screw 162, a nut 164 threaded thereto, a pivotable mount 166 for said screw at its inner end, supporting the screw on a bracket 168, and a sleeve 170 mounted on the outer end of said screw and abutting said nut. The outer end of the sleeve is connected by means of a pivotable mount 172 to the rear end of the cantilever arm. Bracket 168 is affixed to the auger head.

It will now be understood, that cantilever arms 154 may be pivoted outwardly on pins 150 and against the bias of torsion springs 156 by means of jacks 160, this being accomplished by rotating nuts 164 on screws 162 in a direction to move sleeves 170 outwardly. The angular positions of the cantilever arms are controlled by the nuts. When it is desired to restore the cantilever arms to their recessed positions, nuts 164 are actuated in the opposite direction and torsion springs 156 will apply sufficient pressure upon the cantilever arms to return them to recesses 152.

It will also be seen that secured to cantilever arms 154 is a plurality of coal-cutting bits 174. When the cantilever arms are in their recessed positions (FIG. 9) these bits 174 may project slightly beyond the confines of the auger head. When it is desired to expand the cutting diameter of the auger head, cantilever arms 154 are pivoted to selected angular positions, the angle of the arms determining the effective diameter of the auger head. See FIG. 10. Bits 174 will now cut the coal radially beyond the cutting diameter of bits 140 and 146. For example, assuming that the cutting diameter of bits 140 and 146 is 30 inches, cantilever arms 154 may expand the operative diameter of the auger head to as much as 48 inches. Or, if the cutting diameter of bits 140 and 146 is only 24 inches (for relatively thin seams) the cantilever arms may increase the operative diameter of the auger head to as much as 42 inches. This is a very useful feature which greatly increases the versatility of the auger and adapts it to the varying conditions which may be encountered, e.g., different seams of different thickness, or an inconsistent seam of varying thickness.

The auger which is illustrated in FIGS. 9 and 10 is provided with two coal-conveying means. The first is a plurality of coal scoops 180 which are mounted at the rear ends of the cantilever arms. These scoops orbit with the auger head, scoop up loose coal, and deposit same on a scraper conveyor. The other conveyor means comprises one or more spiral or helical conveyors 182, 184 which are internally mounted within the auger head. Unlike the spiral or helical conveyors previously described, conveyors 182, 184 are not fixed to the auger head. Instead, they are mounted on a rotatable tubular shaft 186 which is concentric with planetary gear drive shaft 125. Tubular shaft 186 is connected to a sun gear 188 which is freely rotatable about drive shaft 125. Sun gear 188 is connected to a pair of planetary gears 190 on shafts 132. Since these shafts 132 are connected to planetary gears 127, rotation of shaft 125 will cause rotation of shaft 186, thereby causing spiral or helical conveyors 182, 184 to revolve relative to the auger head. Since shaft 125 may be driven at any angular velocity relative to main drive shaft 123, conveyors 182, 184 may be operated at speeds producing adequate coal conveying capacity. Obviously this capacity is proportionate to the cutting capacity of bits 140 since the operative speed of the conveyors is proportionate to the operative orbital speed of these bits.

The foregoing description is illustrative of the basic principles of this invention and it will be understood that variations are contemplated therein, within the scope of the appended claims, to adapt the invention to different minerals and conditions. For example, although the primary function of the claimed auger is to mine coal, it is equally suited for extracting other materials such as potash, sulphur, salt, bauxite, clay and various ores. The invention is also applicable to tunnelling per se, without regard to the recovery of minerals.

Design variations are also contemplated within the scope of the appended claims. For example, the annexed drawings show planetary gear systems comprising four radially extending trains of planetary gears clustered around a sun gear, each train consisting of either three or four planetary gears. This is purely illustrative, since a single auger head may have fewer or more than four radial trains of planetary gears, and each train may comprise fewer or more than three or four gears.

It is claimed:

1. An auger for tunnelling or mining coal or other minerals, said auger comprising:
   a. a hollow cylindrical auger head,
   b. a first tubular drive shaft connected to the rear end of said auger head to rotatably drive same,
   c. a plurality of cutting bits mounted at the forward end of said auger head for rotation therewith, and
   d. additional cutting bits mounted on said auger head and projecting laterally therefrom,
   e. said additional cutting bits being supported by laterally adjustable supports for extending said additional cutting bits at selected increments beyond the circumference of the auger head to expand the effective cutting radius thereof,
   f. the laterally adjustable supports for the laterally projecting cutting bits comprising a plurality of generally radially extending arms supported by the auger head,
   g. a plurality of eccentrics mounted within the auger head and engaging the inner ends of said radial arms,
   h. the cutting bits being mounted on the outer ends of said radial arms, and
   i. means for angularly adjusting said eccentrics to project said radial arms in outward direction from the auger head and thereby to expand the effective cutting radius of the auger head,
   j. said eccentrics being mounted on a second tubular drive shaft,
   k. said second tubular drive shaft being mounted within said first tubular drive shaft coaxially therewith, and
   i. coupling means between said first and second tubular drive shafts to enable the first of said shafts to drive the second shaft integrally therewith,
   m. said coupling means being adjustable to adjust the angular relationship between the two shafts,
   n. whereby adjusting the angular position of the second shaft relative to the first shaft adjusts the angular positions of the eccentrics to adjust the radial positions of the radial arms and their cutting bits.

2. An auger in accordance with claim 1, wherein:
   a. the laterally adjustable supports for the laterally projecting cutting bits comprise a plurality of cantilever arms which are mounted on the auger head longitudinally thereof,
   b. said cantilever arms being pivotally supported at their forward ends on said auger head, and
   c. screw jacks mounted between the rear ends of said cantilever arms and the rear end of the auger head for pivoting said cantilever arms and the cutting bits thereon radially outwardly from the auger head,
   d. said cantilever arms being thereby movable to selected angular positions relative to the longitudinal axis of the auger head and causing the cutting bits thereon to define a generally conical cutting configuration when the auger head is in operation.

3. An auger in accordance with claim 1, wherein:
   a. the laterally adjustable supports for the laterally projecting cutting bits comprise a plurality of generally radially extending arms supported by the auger head,
   b. a crankshaft mounted within the auger head and engaging the inner ends of said radial arms,
   c. the cutting bits being mounted on the outer ends of said radial arms, and d. means for angularly adjusting said crankshaft to project said radial arms in outward direction from the auger head and thereby to expand the effective cutting radius of the auger head.

4. An auger in accordance with claim 3, wherein:

a. the crankshaft extends axially of the auger head and coaxially with the first tubular drive shaft, and b. coupling means between said first tubular drive shaft and said crankshaft to enable said drive shaft to drive said crankshaft integrally therewith, c. said coupling means being adjustable to adjust the angular relationship between said drive shaft and said crankshaft, d. whereby adjusting the angular position of the crankshaft relative to said drive shaft adjusts the radial positions of the radial arms and their cutting bits.

5. An auger in accordance with claim 1, wherein:

a frame is secured to the forward end of the auger head for integral movement therewith, b. a sun gear and a plurality of planetary gears are mounted on said frame, c. said forwardly mounting cutting bits being operatively connected to said sun and planetary gears for individual coaxial rotation therewith, and d. drive means connected to said sun gear for rotating same and thereby also rotating said planetary gears, e. whereby said drive means causes the forwardly mounted cutting bits to rotate about their individual axes while they are caused to orbit about the axis of rotation of the auger head.

6. An auger in accordance with claim 5, wherein:

a. the sun gear drive means comprises an inner drive shaft which is mounted within said first tubular drive shaft, coaxially therewith, b. said inner drive shaft being driven at a different angular speed from that of the first tubular drive shaft, c. said inner drive shaft being connected to the sun gear for driving said sun gear and the planetary gears connected therewith about their individual axes while the first tubular drive shaft drives the auger head about its longitudinal axis, d. whereby the forwardly mounted cutting bits are caused to engage in both rotational and orbital movement concurrently.

7. An auger in accordance with claim 1, wherein:

a hollow auger head is provided with communicating forward and rearward openings through which material cut by the forwardly mounted cutting bits is adapted to pass when the auger head advances, b. said hollow auger head being also provided with internal spherical conveyor means adapted to move said material through said auger head.

8. An auger in accordance with claim 7, wherein:

a. the spherical conveyor is fixed to the inner wall of the hollow auger head for integral movement therewith, b. whereby the conveyor is caused to rotate and convey the cut material when the auger head rotates.

9. An auger for tunnelling or mining coal or other minerals, said auger comprising:

a. a hollow cylindrical auger head, b. a first tubular drive shaft connected to the rear end of said auger head to rotatably drive same c. a plurality of cutting bits mounted at the forward end of said auger head for rotation therewith, and d. additional cutting bits mounted on said auger head and projecting laterally therefrom, e. said additional cutting bits being supported by laterally adjustable supports for extending said additional cutting bits at selected increments beyond the circumference of the auger head to expand the effective cutting radius thereof, f. the hollow auger head being provided with communicating forward and rearward openings through which material cut by the forwardly mounted cutting bits is adapted to pass when the auger head advances, g. said hollow auger head being also provided with internal spherical conveyor means adapted to move said said material through said auger head, h. an additional tubular drive shaft being mounted within said hollow auger head, coaxially with said first tubular drive shaft, i. a third drive shaft extending through said first and additional tubular drive shafts, coaxially therewith, j. a sun gear driven by said third drive shaft, k. a plurality of planetary gears driven by said sun gear, l. said forwardly mounting cutting bits being connected to said sun and planetary gears for rotational movement therewith about their individual axes, m. a second sun gear connected to said additional tubular drive shaft, n. a plurality of additional planetary gears connected to said second sun gear and to the first mentioned planetary gears, o. whereby operation of the first tubular drive shaft causes the auger head, first sun and planetary gears and cutting bits connected to said gears to rotate integrally with each other about the longitudinal axis of the first tubular drive shaft, and p. whereby rotation of said first sun and planetary gears causes rotation of said second sun and planetary gears and the additional tubular drive shaft to which said second sun gear is connected, q. said internal spherical conveyor means being affixed to said additional tubular drive shaft, r. whereby rotation of said additional tubular drive shaft, caused by rotation of said second sun and planetary gears, causes rotation of said spherical conveyor means relative to the auger head.

* * * * *